US008336727B2

(12) United States Patent
Linden et al.

(10) Patent No.: US 8,336,727 B2
(45) Date of Patent: Dec. 25, 2012

(54) CONTAINER FOR A SUBSTANCE, IN PARTICULAR A DRINK, WITH A TEAR-OPEN CLOSING ELEMENT

(75) Inventors: Paolo Linden, Borgo san Dalmazzo (IT); Edmondo Camurri, Turin (IT)

(73) Assignee: International Patents and Brands Corporation, Panama (PA)

( * ) Notice: Subject to any disclaimer, the term of this patent is extended or adjusted under 35 U.S.C. 154(b) by 211 days.

(21) Appl. No.: 12/677,016

(22) PCT Filed: May 8, 2008

(86) PCT No.: PCT/EP2008/055707

§ 371 (c)(1), (2), (4) Date: Jun. 22, 2010

(87) PCT Pub. No.: WO2009/030526

PCT Pub. Date: Mar. 12, 2009

(65) Prior Publication Data

US 2010/0258562 A1 Oct. 14, 2010

(30) Foreign Application Priority Data

Sep. 7, 2007 (IT) ..... UD2007A0159

(51) Int. Cl.
*B65D 17/34* (2006.01)
*B65D 17/28* (2006.01)

(52) U.S. Cl. ..... 220/269; 220/268; 220/266

(58) Field of Classification Search ..... 220/273, 220/272, 268, 265, 260, 906; *B65D 17/34, B65D 17/28*

See application file for complete search history.

(56) References Cited

U.S. PATENT DOCUMENTS 3,478,918 A * 11/1969 Zundel ..... 220/273
3,712,503 A * 1/1973 Zundel ..... 220/273

(Continued)

FOREIGN PATENT DOCUMENTS

FR 2675467 10/1992

(Continued)

OTHER PUBLICATIONS

International Search Report of PCT/EP2008/055707, dated Aug. 27, 2008.

*Primary Examiner* — Mickey Yu
*Assistant Examiner* — Robert J Hicks
(74) *Attorney, Agent, or Firm* — Hamre, Shumann, Mueller & Larson, P.C.

(57) ABSTRACT

A container for substances comprises an upper wall, which functions as a lid, with a central zone on which a closed line of weakening defines a stopper, in the shape of a tongue, which normally closes a relative aperture for the substance to pass through; a lever, associated with the tongue, which can be driven so as to remove the stopper, at least partly, from the upper wall, detaching it along the line of weakening and thus freeing the aperture; and a connection element of the flexible type which is connected both to the stopper and also to the upper wall. The lever has a first end pivoted in correspondence with a peripheral rib, a second end, which functions as a gripper element, disposed in substantial correspondence with the central zone, and an intermediate zone between the two ends, wherein the lever is connected to the stopper.

11 Claims, 7 Drawing Sheets

U.S. PATENT DOCUMENTS

| | | | | | |
|---|---|---|---|---|---|
| 3,730,380 | A | * | 5/1973 | Silver | 220/269 |
| 3,731,836 | A | | 5/1973 | Silver | |
| 3,795,340 | A | | 3/1974 | Hougen et al. | |
| 3,877,606 | A | * | 4/1975 | Silver | 220/269 |
| 4,189,060 | A | | 2/1980 | Trotman, III | |
| 4,417,668 | A | * | 11/1983 | Stolle | 220/269 |
| 4,687,116 | A | * | 8/1987 | Dutt et al. | 220/270 |
| 5,145,086 | A | | 9/1992 | Krause | |
| 6,062,414 | A | * | 5/2000 | Mongarli et al. | 220/269 |

FOREIGN PATENT DOCUMENTS

| | | |
|---|---|---|
| WO | 01/02260 | 1/2001 |

* cited by examiner

CONTAINER FOR A SUBSTANCE, IN PARTICULAR A DRINK, WITH A TEAR-OPEN CLOSING ELEMENT

FIELD OF THE INVENTION

The present invention concerns a container, for example in the form of a can, able to contain any substance whatsoever, in particular a drink. The container comprises an upper wall, which functions as a lid, which in turn comprises a closing element, in the form of a tongue which, thanks to a lever mechanism, can be completely opened towards the outside, and therefore without coming into contact with the substance contained inside. Moreover, even when it is open, it remains solid with the remaining part of the lid, so that it is easy to dispose of together with the rest of the container.

BACKGROUND OF THE INVENTION

Containers are known for substances such as solid foods and drinks, such as tins or cans, having a lateral surface, a bottom and an upper wall, opposite the bottom, all made of aluminum, steel or alloys thereof.

The upper wall, which acts as a lid, has a closed line of weakening, which defines the contour of a closing element, which functions as a stopper, and a corresponding aperture. A lever, normally provided at one end with a lifting eyelet, is associated with the stopper and can be inclined to cause the detachment of the stopper from the remaining part of the lid, along said line of weakening. The stopper is then bent towards the outside and completely removed. The disadvantage of these known containers is that, when they are open, the lever and the stopper are completely separate from the container and can be dispersed in the environment, polluting it and at the same time constituting a danger for those who accidentally come into contact with them.

A container for drinks of a known type which solves this problem has the line of weakening which is not closed on itself. In this case, to open the stopper, driving the lever causes the stopper to bend over, along the line of weakening, inside the container, through the relative aperture. In this way, however, the external part of the stopper, which is not normally protected from external contamination, is put in direct contact with the substance inside the container, with a serious risk for the health of whomsoever then ingests the substance, thus rendering ineffective the precautions with regard to sterility with which the container has been filled with the substance and sealed.

The need to eliminate the potential contamination of the substance in the container is the subject of new health regulations on a world-wide level, which expressly forbid the production and marketing of containers which have a stopper, potentially contaminated, that can come into contact with the substance located inside the container.

To satisfy these regulations, and to prevent the stopper from being dispersed in the environment, it is known to make containers with a so-called hygienic stopper, which opens towards the outside of the container and which remains connected to the container even when it is open.

One example of a known container has the line of weakening closed and has a metal tongue of a flexible type, attached by one end to the upper wall and also attached both to the stopper and to the lever.

By rotating the relative lever in a clockwise direction, the stopper is cut and bent to the outside of the container but, thanks to the flexible tongue, it remains solid with the container. The disadvantage of this known container is that the lever, because of how it is disposed and made, cuts and removes the stopper by means of a tear-away action which, since it requires an overall effort greater than other known containers, is disadvantageous and not very practical.

Purpose of the present invention is to achieve a container for drinks which allows to remove the stopper from the aperture in such a manner as to guarantee good hygienic conditions of the drink inside the container, that is, which has a hygienic stopper, that the stopper remains solid with the container, so that it is not dispersed in the environment, and that it is practical and does not require great effort to remove the stopper.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe other characteristics of the invention or variants to the main inventive idea.

In accordance with the above purpose, a container for a substance, in particular a drink, according to the present invention, comprises at least an upper wall functioning as a lid, having a peripheral rib and a central zone solid with said peripheral rib and on which a line of weakening is made, which defines a tear-open closing element, which functions as a removable stopper to a relative aperture for the passage of said substance, made in said central zone. The container also comprises a lever having at least one part connected to said closing element and able to be driven so as to at least partly remove said closing element from the remaining part of said central zone, detaching it along said line of weakening and thus put said aperture in communication with the outside.

According to a characteristic feature of the present invention, said lever comprises: a first end able to function as a fulcrum; a second end, opposite the first, which is disposed in substantial correspondence with said central zone and is able to function as a gripper element; and an intermediate zone, between said two ends, by means of which the lever is connected to said closing element.

Said first end of the lever, able to function as a fulcrum, can be disposed advantageously in correspondence with said peripheral rib, or said central zone. In any case the lever is a first class lever, that is, always advantageous, since the point of application of the resistant force (connection to the closing element) is intermediate between the fulcrum (first end of the lever) and the point of application of the lifting force (second end of the lever).

Advantageously, the method to open said closing element comprises the following steps:

- lifting the second end of said lever pivoting on said first end, so that said intermediate zone of said lever partly detaches said closing element from the remaining part of said central zone, along said line of weakening; and
- pulling said second end of said lever backwards, so as to lift said closing element and continue to detach it along said line of weakening until the aperture is opened.

In this way we advantageously achieve the set purpose of opening the stopper of the container easily and without great effort, in only two steps, without any part of the stopper coming into contact with the substance contained inside the container, and keeping the stopper always solid with the remaining part of the container.

Moreover, in order to further increase the hygienic character of the container, it is also provided to at least partly cover the lid with a hygienic film, able to be removed together with the closing element, or before accessing the lever that drives the closing element.

BRIEF DESCRIPTION OF THE DRAWINGS

These and other characteristics of the present invention will become apparent from the following description of some preferential forms of embodiment, given as a non-restrictive example with reference to the attached drawings wherein.

DETAILED DESCRIPTION OF SOME PREFERENTIAL FORMS OF EMBODIMENT

Figure 1:
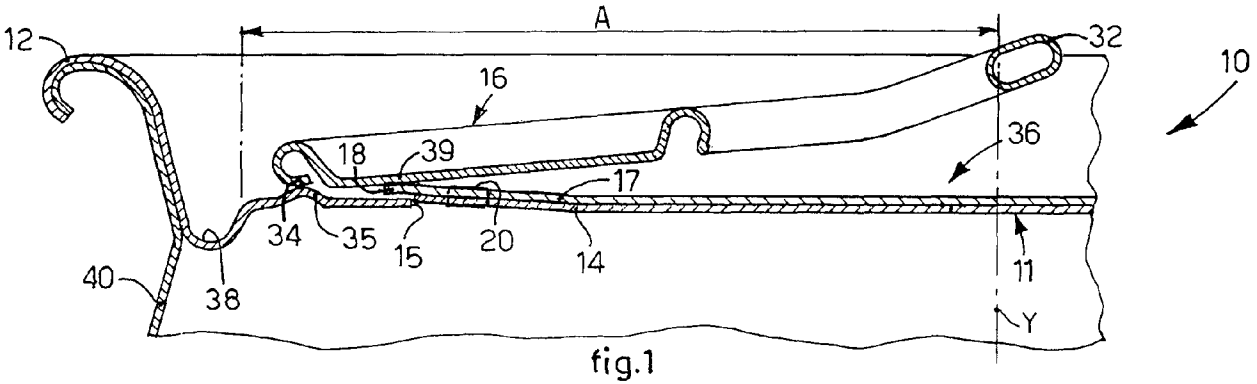
FIG. 1 is a partial cross section of a container according to the present invention, according to a first form of embodiment.

With reference to FIG. 1, a container 10 according to the invention is represented by a can to contain a substance, such as for example a drink. The container 10 is made for example of aluminum, steel or alloys thereof, it is substantially cylindrical in shape and has an external lateral surface 40, an upper wall 11, which functions as a lid, and a bottom, of any type, known, and not shown in the drawings.

The upper wall 11 is substantially circular in shape (FIGS. 2 and 3), concentric with respect to a central axis Y (FIGS. 1 to 15). Furthermore, the upper wall 11 has a peripheral rib 12 of annular shape, which delimits a central zone 36 having a determinate radius A.

A groove 38 is made on the upper wall 11 and, in the form of embodiment shown in FIGS. 1 to 15, is defined by a circular closed line, concentric to the peripheral rib 12.

On the central zone 36, a line of weakening 13 (FIG. 2) is made, in a known manner, closed on itself, having a locally reduced or variable cross section, which delimits a closing element or stopper 14 in the shape of a tongue. The stopper 14 normally closes a corresponding aperture 15 through which the substance can be removed from the container 10. In particular, when the container 10 is in a closed condition (FIG. 2), the stopper 14 closes the aperture 15 completely and hermetically, whereas in an open condition it is raised and at least partly removed from the aperture 15 (FIG. 3), although it remains solid with the remaining part of the container 10.

The stopper 14, as will be shown in more detail hereafter in the description, is solidly attached to a lever 16 which, in the closed condition (FIG. 2), at least partly overlaps the stopper 14.

The lever 16 is driven manually, by means of a gripping end thereof, or ring 32, to separate the stopper 14 from the remaining part of the upper wall 11, along the line of weakening 13.

The ring 32 faces towards the inside of the upper wall 11, that is, towards the central zone 36, to make it easier to grip and drive the lever 16. Advantageously, in the closed condition the ring 32 is substantially in correspondence with the central axis Y passing through the center of the central zone 36.

The lever 16 is pivoted on one end 34 (FIG. 1) opposite the ring 32, that is, disposed substantially in correspondence with the peripheral rib 12. In particular, in the closed condition (FIG. 2) the end 34 is outside the line of weakening 13 and rests in direct contact on a ridge 35, facing upwards and made on the upper wall 11. The ridge 35 is substantially U-shaped, that is, with two rectilinear segments, opposite and parallel, connected by a curved segment, nearer the peripheral rib 12.

The curved segment of the ridge 35 is at least partly comprised between the peripheral rib 12 and the line of weakening 13 and at least partly surrounds both the stopper 14 and the corresponding aperture 15, and also the lever 16. In particular, the end 34 of the lever 16 rests on the curved segment of the ridge 35 (FIG. 1).

Moreover, the lever 16 comprises an intermediate zone 39 (FIG. 1), comprised between its ends 32 and 34, to which a flexible tongue 17 is attached, which is in turn connected to the stopper 14.

The intermediate zone 39 is advantageously nearer the end 34, which functions as a fulcrum and, in particular is attached for example by means of welding to an end 18 of the tongue 17.

In the closed condition (FIG. 2), the end 18 of the tongue 17 is disposed in substantial proximity with the peripheral rib 12.

The tongue 17 is normally positioned on the upper wall 11, interposed between the lever 16 and the stopper 14 (FIG. 1). In particular, the tongue 17 has an extension such as to cover the whole stopper 14 and is attached to it by means of a rivet 20 (FIG. 1).

Moreover, the tongue 17 has an end 19 (FIG. 2), normally positioned in correspondence with the central zone 36, by means of which it is solidly attached to the upper wall 11, for example with a rivet 37.

In this case, the tongue 17 is also provided with five lines of predetermined bending, respectively 21, 22, 23, 24 and 25, which delimit relative portions thereof 26, 27, 28, 29, 30 and 31.

The first line of bending 21 delimits the portion 26 (FIG. 9), in substantial correspondence with the end 18 of the tongue 17, which functions as a connection element with the lever 16. In this way, since the tongue 17 is in turn solidly attached to the stopper 14, a connection is achieved between the stopper 14 and the lever 16.

The second line of bending 22 defines the portion 27 (FIGS. 8 and 9), which is adjacent to the portion 26 and is attached to the stopper 14 by means of the rivet 20.

The third line of bending 23 defines the portion 28 (FIG. 11), which is disposed adjacent to the portion 27, while the fourth line of bending 24 defines the portion 29 (FIG. 12), which is disposed adjacent to the portion 28.

Finally, the fifth line of bending defines the portion 31 (FIGS. 13 and 14), in correspondence with the end 19 of the tongue 17 and in a position opposite to the portion 26. In particular the portion 31 is attached to the upper wall 11 by means of the rivet 37.

By rotating the lever 16 around its end 34, the end 32 is distanced from the wall 11 and the stopper 14 is partly detached from the upper wall 11, so that the aperture 15 begins to open. This happens because the line of weakening 13 yields, if subjected to a predetermined lifting force.

Since the connection zones between the lever 16 and the tongue 17 and between the tongue 17 and the stopper 14 are different and in close proximity, the lever 16, which acts on the stopper 14, defines an extremely favorable arm that allows, with limited force, to apply a high angular moment.

Furthermore, the force of the lever 16 is applied at a point of application in close proximity with the line of weakening 13 and with a rotation towards the outside of the container 10. What is more, the resistant section of the line of weakening 13 on which the lever 16 acts is much smaller than the remaining part of the line of weakening 13. Therefore, from the above, it is clear that the force necessary to lift the stopper 14 along the line of weakening 13 is much less compared with containers with a hygienic stopper that are known in the state of the art.

A further distancing upwards of the end 34 of the lever 16 allows to remove the stopper 14 completely from the upper wall 11 and to position the flexible tongue 17 in its bent configuration.

In the bent configuration (FIG. 15), the flexible tongue 17 is positioned above the upper wall 11 and at the side of the aperture 15, while its portions 26, 27, 28, 29, 30, 31 are substantially parallel to the wall 11 and overlapping each other. In the bent configuration, the portion 26 is in an upper position, immediately below the lever 16, while the portion 31 is below all the other portions 26, 27, 28, 29 and 30, in contact with the upper wall 11. Consequently, in the bent configuration of the flexible tongue 17, the portions 27, 28, 29 and 30 are positioned between the portion 26 and the portion 31, as can be clearly seen in FIGS. 14 and 15.

The rivet 20, cooperating with one edge of the lever 16, also selectively keeps the flexible tongue 17 in its bent configuration.

It is clear that the stopper 14, since it is solid with the tongue 17, is also able to bend into relative portions, which are positioned one above the other, in correspondence with the intermediate lines of bending 22, 23 and 24 of the tongue 17.

As described above, in the bent configuration, the portions 26, 27, 28, 29, 30 and 31 overlap each other concertina-wise, and the lever 16 is positioned above them. In this way, the lever 16 does not protrude excessively from the container 10, and neither the lever 16 nor the tongue 17, nor the stopper 14 are an impediment to the user who wants to remove the substance from the container 10.

The container 10 as described heretofore is used as follows.

Figure 2:
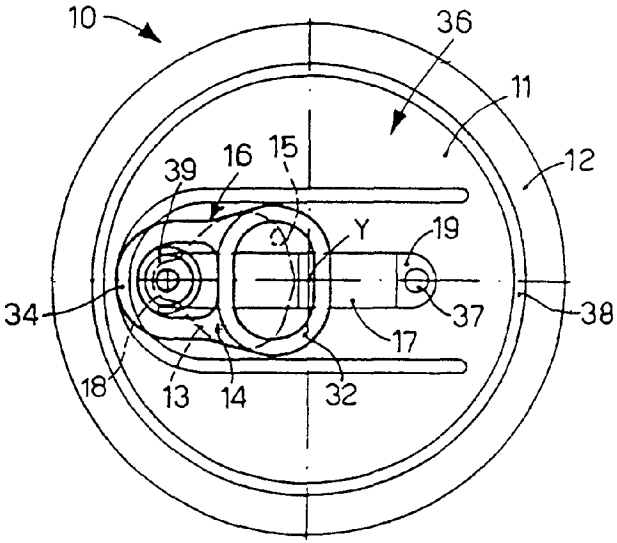
FIG. 2 is a plane view of the container in FIG. 1, in a closed condition.
Figure 4:
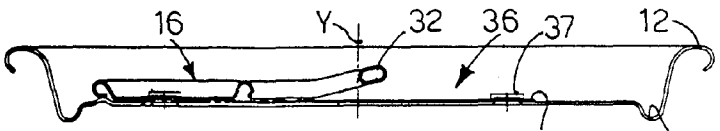
Figure 7:
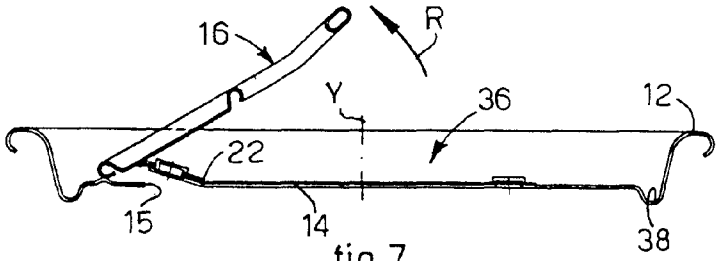
Figure 6:
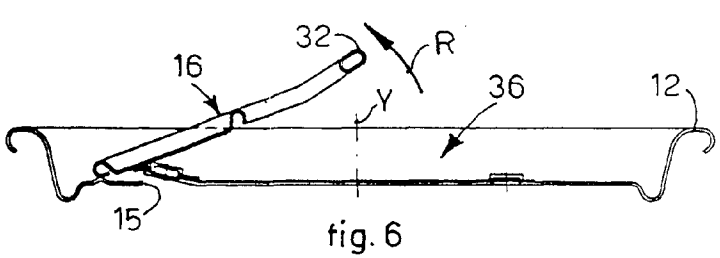
Figure 9:
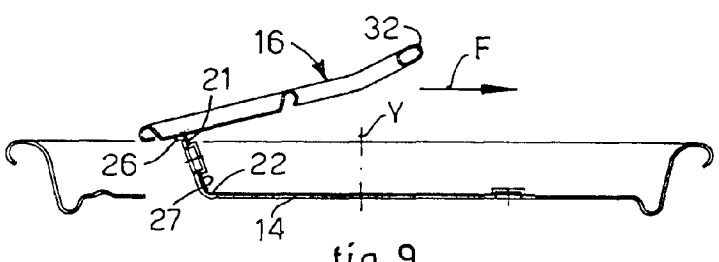
Figure 8:
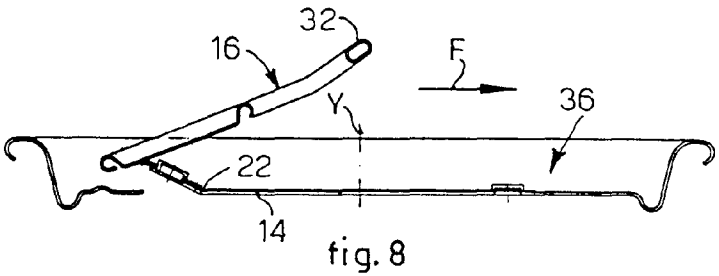
Figure 10:
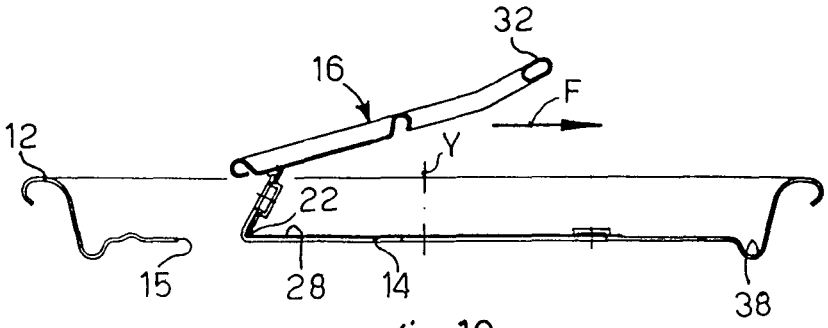

Initially, the container 10 is normally in its closed condition (FIGS. 2 and 4). To open it, the user has to grip the ring 32 of the lever 16 and rotate it in the direction of rotation indicated by the arrow R in FIGS. 5, 6 and 7, around its end 34. This causes a part of the stopper 14 to be detached from the remaining part of the upper wall 11, and also the consequent definition of a part of the aperture 15, in correspondence with the portion 27, and the bending of the stopper 14 and the tongue 17, along the line of bending 22.

The stopper 14 is lifted upwards and therefore never enters into contact with the substance contained in the container 10, guaranteeing that the optimum hygienic conditions under which the substance was inserted into the container 10 are maintained.

Figure 3:
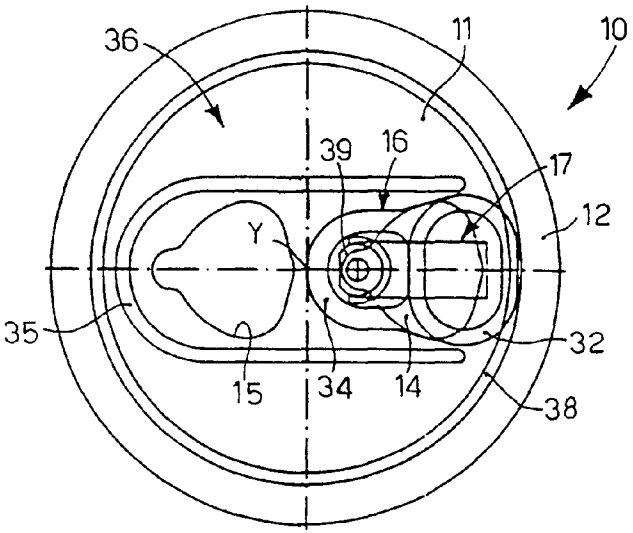
FIG. 3 is a plane view of the container in FIG. 1, in an open condition.
Figure 5:
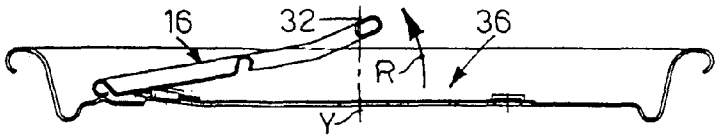
FIGS. 4 to 15 are schematic cross sections of part of the container in FIG. 1, which represent, in sequence, the steps for opening the closing element of the container.
Figure 11:
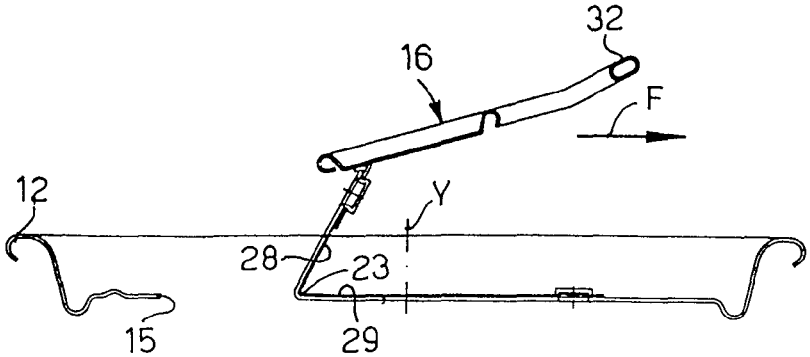
Figure 12:
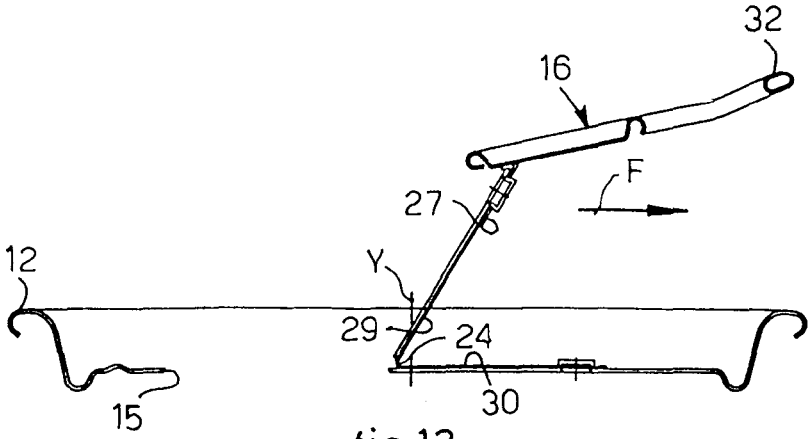
Figure 13:
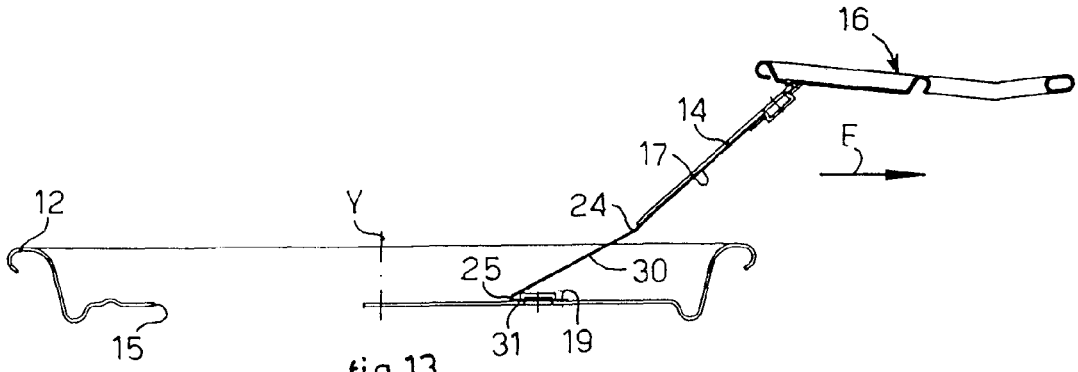

Subsequently, the user pulls the lever 16 with a tangential force, in the direction of the arrow F in FIGS. 8 to 13, causing the further inclination beyond 90° of the stopper 14 and the tongue 17, in correspondence with the line of bending 22 (FIGS. 7 to 10) and, subsequently, causing the stopper 14 and tongue 17 to bend along the lines of bending 23 and 24 and to incline even further (FIGS. 11 and 12). In this way, the stopper 14, while remaining solid with the portions 27 and 28 of the tongue 17, in turn attached to the upper wall 11, completely frees the aperture 15 and the container 10 is put in its open condition (FIGS. 3, 12 and 13).

Figure 14:
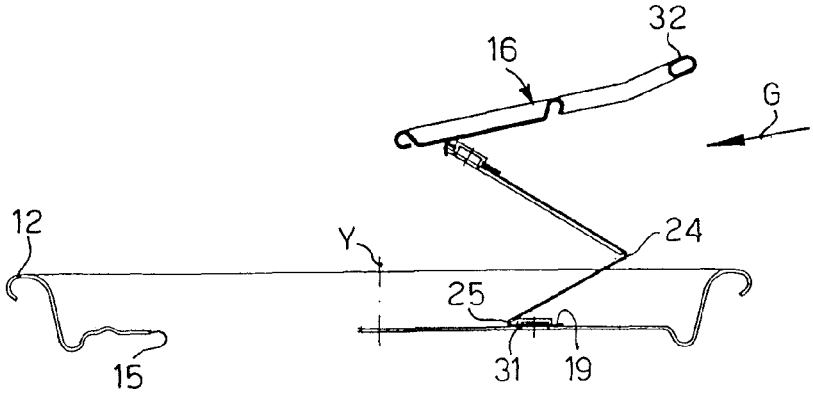
Figure 15:
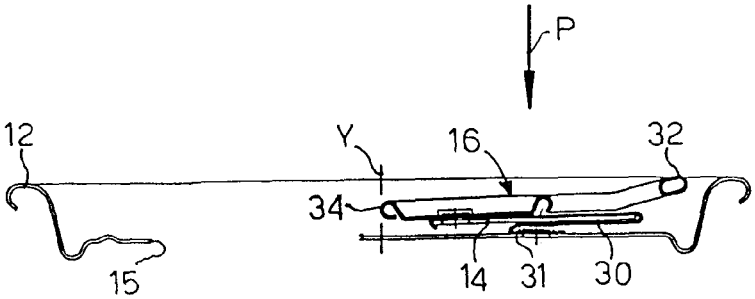

At this point, with a movement in the direction as indicated by the direction of the arrow G in FIG. 14, the portions 26, 27, 28, 29, 30 and 31 of the tongue 17, the stopper 14 and the lever 16 are made to overlap. Finally, as indicated by arrow P in FIG. 15, the portions 26, 27, 28, 29, 30 and 31 of the tongue 17, the stopper 14 and the relative lever 16 close concertina-wise.

Thanks to the lines of bending 21, 22, 23, 24 and 25, the lever 16, the stopper 14 and the flexible tongue 17 are easily repositioned several times in the closed condition, allowing the user to close the container 10 with the stopper 14 as desired and temporarily.

Figure 16:
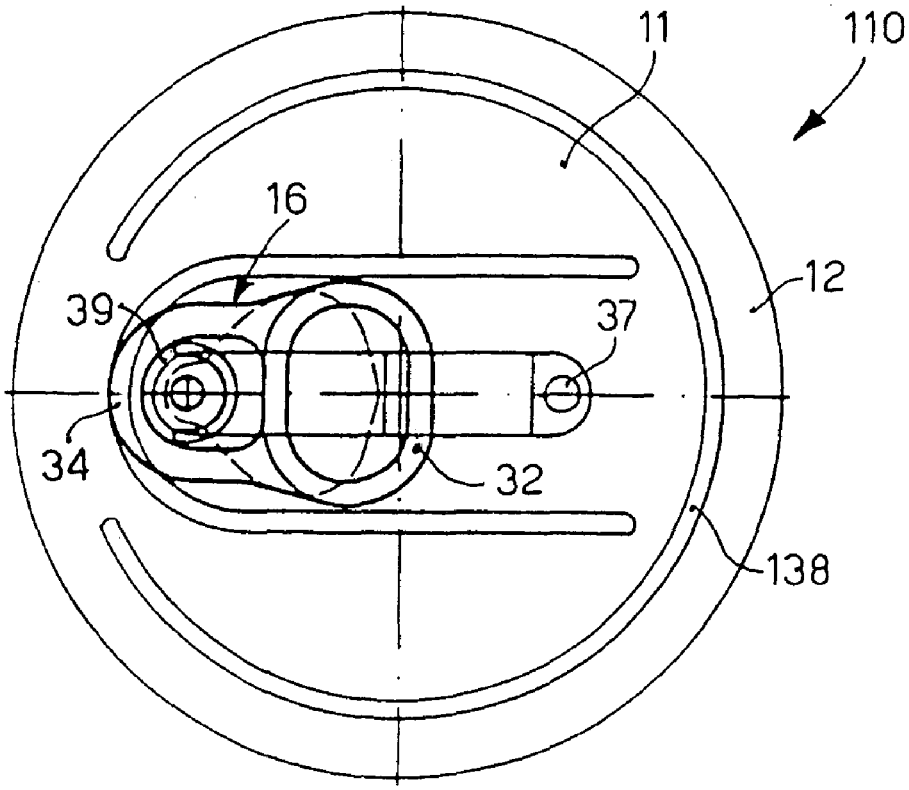
FIG. 16 is a plane view of a variant of the container in FIG. 1, in a closed condition.
Figure 17:
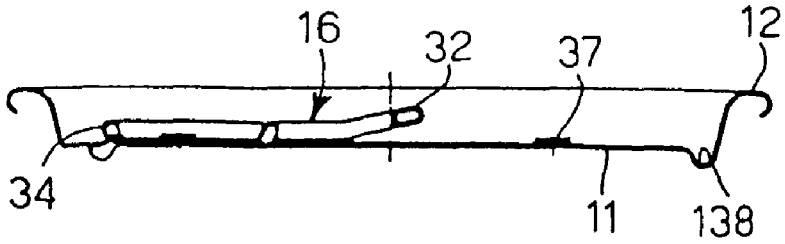
FIG. 17 is a cross section of the container in FIG. 16.
Figure 24:
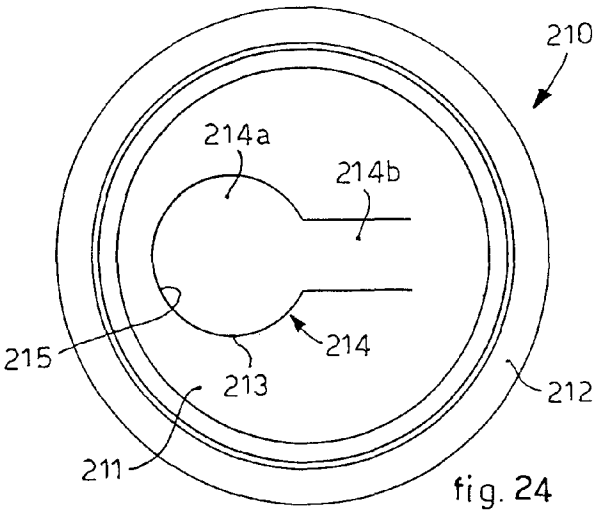
FIG. 24 is a plane view of some details of the container in FIG. 18.

According to a variant, a container 110 according to the present invention, shown in FIGS. 16 and 17, where the same reference numbers correspond to equivalent parts, comprises a groove 138, made on the upper wall 11, which instead of being closed like the groove 38, is open, that is, interrupted in correspondence with the stopper 14 and the aperture 15. In this way the substance contained in the container 110, once it has come out, is prevented from stagnating, partly, in the groove 138, creating unhygienic conditions.

According to another variant, not shown in the drawings, the lever 16 is provided with a gripping ring of double size with respect to the ring 32, so as to be able to drive the lever 16 more easily with two fingers, instead of one, as normally happens.

In accordance with a second form of embodiment, shown in FIGS. 18 to 24, a container 210 has an upper wall 211 provided with a peripheral rib 212 of annular shape, which delimits a central zone 236.

A groove 238, analogous to the groove 38, is made on the upper wall 211.

Figure 22:
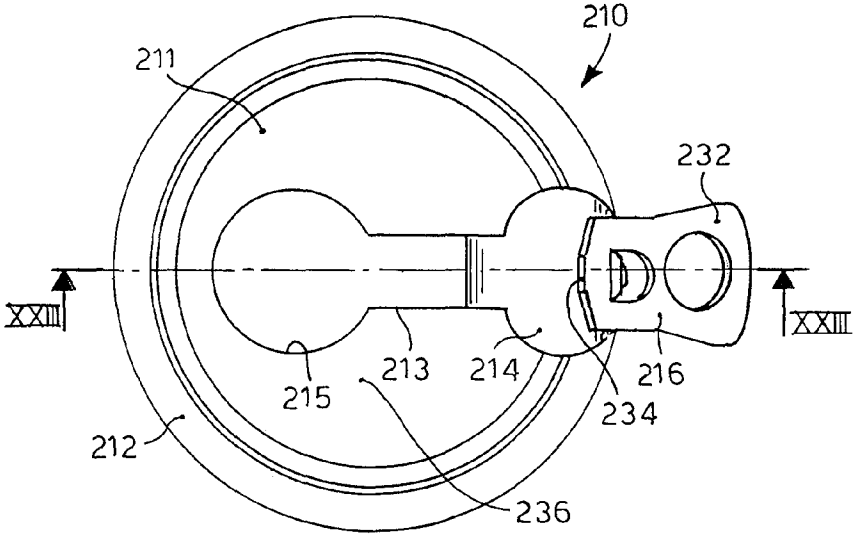
FIG. 22 is a plane view of the lid in FIG. 18 in a completely open condition.
Figure 23:
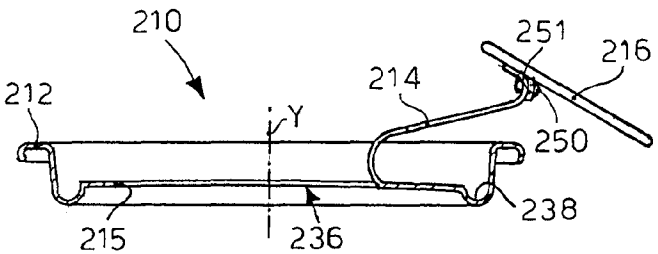
FIG. 23 is a cross section from XXIII to XXIII of FIG. 22.
Figure 20:
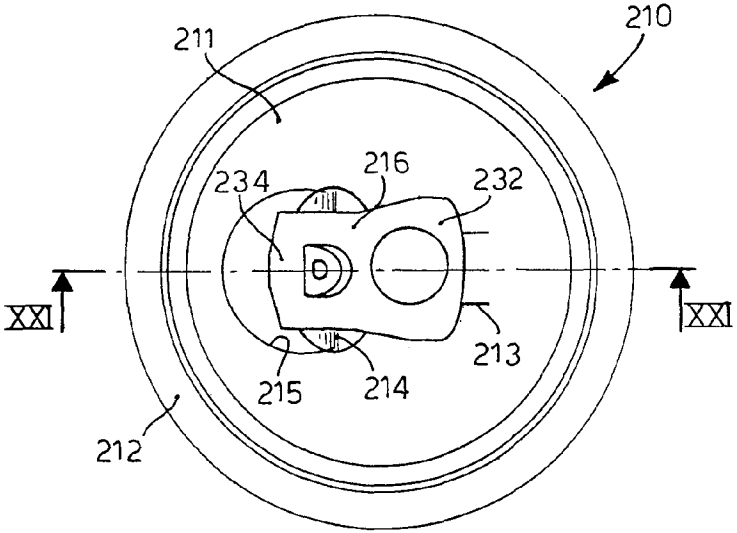
FIG. 20 is a plane view of the lid in FIG. 18 in a partly open condition.
Figure 21:
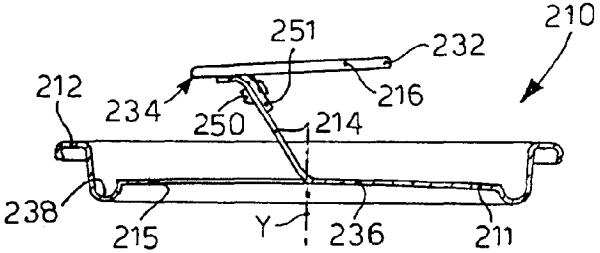
FIG. 21 is a cross section from XXI to XXI of FIG. 20.

A line of weakening 213 is made on the central zone 236, which is not closed on itself and which delimits a closing element or stopper 214, in the form of a tongue, always integral with the remaining part of the central part 236, even when it is in the open condition (FIGS. 22 and 23).

In particular, the stopper 214 (FIG. 24) comprises a first part **214*a* substantially circular in shape, and a second part 214*b* substantially rectangular in shape and contiguous to the first part 214*a*. The stopper 214 normally closes a corresponding aperture 215 and is solidly attached to a lever 216 which, in the closed condition (FIGS. 18 and 19**), is at least partly overlapping therewith.

The lever 216 is driven manually, by means of a gripping end thereof, or ring 232, to separate the stopper 214 from the remaining part of the central zone 236 of the upper wall 211, along the line of weakening 213.

The lever 216 is pivoted at one end 234 (FIG. 18) opposite the ring 232, that is, disposed substantially in correspondence with the peripheral rib 212.

Moreover, the lever 216 comprises an intermediate zone 239 (FIG. 18), comprised between its ends 232 and 234 on which a flexible tongue 251 is made, which is in turn connected to the stopper 214 by means of a rivet 250.

The intermediate zone 239 is advantageously nearer the end 234, which functions as a fulcrum.

The stopper 214 is removed as follows: firstly the ring 232 of the lever 216 is lifted manually towards the outside of the container 210, pivoting on its first end 214, so that the intermediate zone 239 of the lever 216 partly detaches the stopper 214 from the remaining part of the central zone 236 (FIGS. 20 and 21), along the line of weakening 213; then the ring 232 is pulled back so as to lift the stopper 214 and continue to detach it along the line of weakening 213, until the aperture 215 is completely open (FIGS. 22 and 23).

Figure 25:
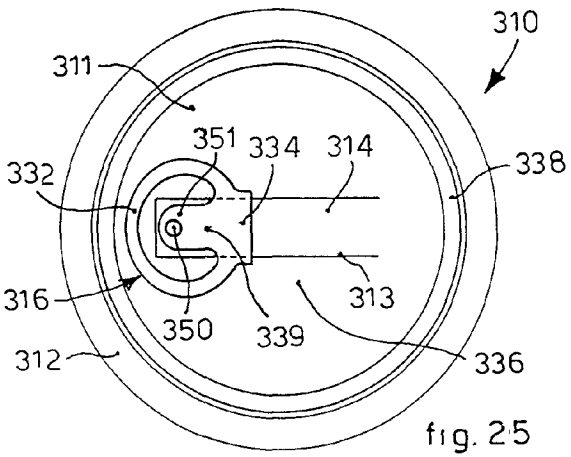
FIG. 25 is a plane view of a lid of a container according to the present invention, according to a third form of embodiment.
Figure 18:
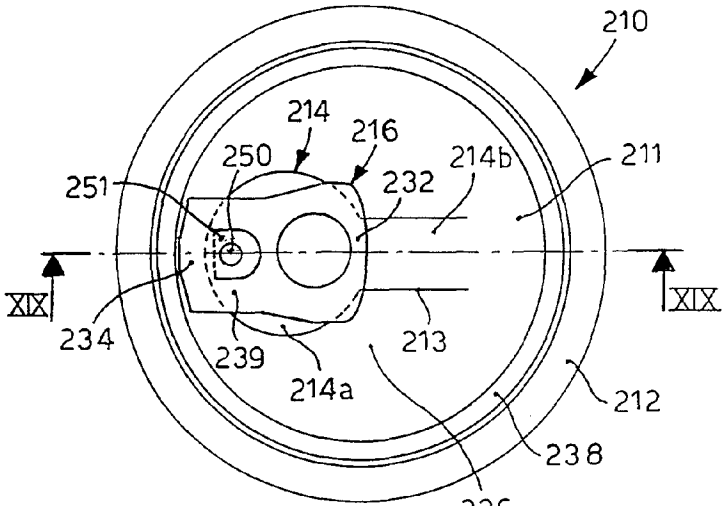
FIG. 18 is a plane view of a lid of a container according to the present invention, according to a second form of embodiment, in a closed condition.
Figure 19:
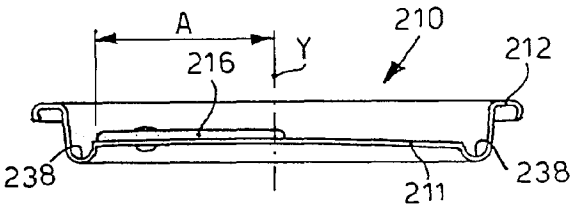
FIG. 19 is a cross section from XIX to XIX of FIG. 18.

FIG. 25 shows a third form of embodiment of a container 310 according to the present invention, which comprises an upper wall 311 provided with a peripheral rib 312 of annular shape, which delimits a central zone 336.

A groove 338, analogous to the grooves 38 and 238, is made on the upper wall 311.

A line of weakening 313 is made on the central zone 336, which (like the line 213) is not closed on itself and which delimits a closing element or stopper 314, in the form of a tongue, always integral with the remaining part of the central part 336, even when it is in the open condition.

In particular, the stopper 314 has a substantially rectangular shape, it normally closes a corresponding aperture 315 and is solidly attached to a lever 316 which, in the closed condition, is at least partly overlapping therewith.

The lever 316 is driven manually, by means of a gripping end thereof, or ring 332, to separate the stopper 314 from the remaining part of the central zone 336 of the upper wall 311, along the line of weakening 313.

The lever 316 is pivoted at one end 334 opposite the ring 332, that is, disposed substantially in correspondence with the center of the central zone 336.

Moreover, the lever 316 comprises an intermediate zone 339 comprised between its ends 332 and 334 on which a flexible tongue 351 is made, which is in turn connected to the stopper 314 by means of a rivet 350.

The stopper 314 is removed as follows: firstly the ring 332 of the lever 316 is lifted manually, bending it towards the center of the upper wall 311, pivoting on its first end 314, so that the intermediate zone 339 of the lever 316 partly detaches the stopper 314 from the remaining part of the central zone 336, along the line of weakening 313; then the ring 332 is further pulled back and on the same side so as to lift the stopper 314 and continue to detach it along the line of weakening 313, until the aperture 315 is completely open.

It is clear that modifications and/or additions of parts may be made to the containers 10, 110, 210, 310 as described heretofore, without departing from the field and scope of the present invention.

It is also clear that, although the present invention has been described with reference to some specific examples, a person of skill in the art shall certainly be able to achieve many other equivalent forms of container for substances, having the characteristics as set forth in the claims and hence all coming within the field of protection defined thereby.

The invention claimed is:

1. A container for a substance, comprising:

an upper wall functioning as a lid having a peripheral rib delimiting a central zone having a substantially circular shape with a determinate radius, concentric with respect to a central axis, solid with said peripheral rib, said central zone including an interrupted line of weakening, said line of weakening defining a pull-open closing element always integral with the remaining part of the central zone and provided with a front terminal part disposed next to said peripheral rib, said pull-open closing element functioning as a removable stopper to a relative aperture for said substance to pass through, made in said central zone; and a lever having a part connected to said closing element wherein said lever can be driven to remove, at least partly, said closing element from the remaining part of said central zone, detaching said closing element along said line of weakening and thus putting said aperture in communication with the outside, said line of weakening being interrupted at one end of said closing element on the opposite side of said lever with respect to said central axis, so that said closing element has an edge solid with the remaining part of said central zone;

wherein said lever comprises:

a first end having a central part of said first end functioning as a fulcrum disposed in correspondence with said peripheral rib, outside said closing element defined by said line of weakening and in front of said front terminal part, said fulcrum being able to determine the lifting of said closing element by drawing;

a second end, opposite said first end and functioning as a gripper lifting and drawing element, disposed in substantial correspondence with said central zone, wherein said first end and said second end are separated a little less than a length of said radius;

and an intermediate zone between said first end and said second end, by means of said intermediate zone said lever being connected to said closing element, said intermediate zone of said lever comprising a flexible tongue mechanically connected to said closing element in the front terminal part thereof, to lift and detach said front terminal part of said closing element from the remaining part of the central zone, without any part of the closing element coming into contact with the substance contained inside the container.

2. The container as in claim 1, wherein said lever is substantially parallel to said radius.

3. The container as in claim 2, wherein said second end is disposed near said central axis.

4. The container as in claim 2, wherein said closing element defined by said line of weakening comprises a tongue having a first part substantially circular in shape and a second part substantially rectangular in shape and contiguous with said first part.

5. The container as in claim 4, wherein said lever is disposed above said first part of said closing element.

6. The container as in claim 4, wherein said intermediate zone of said lever is connected to said first part of said closing element with a mechanical connection means.

7. The container as in claim 6, wherein said mechanical connection means is a rivet or a welding point.

8. The container as in claim 6, wherein said mechanical connection means connects said first part of said closing element and said flexible tongue.

9. The container as in claim 1, wherein said lever can be rotated towards the outside of said peripheral rib.

10. A lid for a container able to contain a substance, comprising: a peripheral rib delimiting a central zone having a substantially circular shape with a determinate radius, concentric with respect to a central axis, solid with said peripheral rib and on which central zone an interrupted line of weakening is made, which line of weakening defines a pull-open closing element always integral with the remaining part of the central zone and provided with a front terminal part disposed next to said peripheral rib, which pull-open closing element functions as a removable stopper to a relative aperture for said substance to pass through, made in said central zone; and a lever, having a part connected to said closing element so that said lever can be driven to remove, at least partly, said closing element from the remaining part of said central zone, detaching said closing element along said line of weakening and thus putting said aperture in communication with the outside, said line of weakening being interrupted at one end of said closing element on the opposite side of said lever with respect to said central axis, so that said closing element has an edge solid with the remaining part of said central zone;

wherein said lever comprises:

a first end having a central part of the first end functioning as a fulcrum disposed in correspondence with said peripheral rib, outside said closing element defined by said line of weakening and in front of said front terminal part, said fulcrum being able to determine the lifting of said closing element by drawing;

a second end opposite said first end and functioning as a gripper, lifting and drawing element, disposed in substantial correspondence with said central zone, wherein said first end and said second end are separated a little less than a length of said radius;

and an intermediate zone between said first end and said second end, by means of said intermediate zone said lever being connected to said closing element, said intermediate zone of said lever comprising a flexible tongue mechanically connected to said closing element in the front terminal part thereof, to lift and detach said front terminal part of said closing element from the remaining part of the central zone, without any part of the closing element coming into contact with the substance contained inside the container and keeping the closing element always solid with the remaining part of the central zone.

11. A method to open a closing element of a container able to contain a substance, wherein said container comprises: an upper wall functioning as a lid, having a peripheral rib delimiting a central zone having a substantially circular shape with a determinate radius, concentric with respect to a central axis, solid with said peripheral rib and on which an interrupted line of weakening is made, which line of weakening defines said pull-open closing element always integral with the remaining part of the central zone and provided with a front terminal part disposed next to said peripheral rib, which closing element functions as a removable stopper to a relative aperture for said substance to pass through, made in said central zone; and a lever, having a part connected to said closing element so that said lever can be driven to remove, at least partly, said closing element from the remaining part of said central zone by drawing, detaching said closing element along said line of weakening, and thus putting said aperture in communication with the outside, said line of weakening being interrupted at one end of said closing element on the opposite side of said lever with respect to said central axis, so that said closing element has an edge solid with the remaining part of said central zone;

wherein said lever comprises:

a first end having a central part of the first end functioning as a fulcrum disposed in correspondence with said peripheral rib, outside said closing element defined by said line of weakening and in front of said front terminal part, said fulcrum being able to determine the lifting of said closing element by drawing, without said closing element going inside the container;

a second end opposite said first end and functioning as a gripper, lifting and drawing element, disposed in substantial correspondence with said central zone, wherein said first end and said second end are separated a little less than a length of said radius;

and an intermediate zone between said first end and said second end, by means of said intermediate zone said lever being connected to said closing element said intermediate zone of said lever comprising a flexible tongue mechanically connected to said closing element in the front terminal part thereof, said method comprises:

lifting said second end of said lever rotating toward the outside of said peripheral rib, pivoting on said first end thereof that cooperates with said peripheral rib and acting externally to the closing element, so that said flexible tongue of said intermediate zone of said lever lifts and detaches the front terminal part of said closing element from the remaining part of said central zone, along said line of weakening, without any part of the closing element coming into contact with the substance contained inside the container and keeping the closing element always solid with the remaining part of the central zone; and pulling backwards said lever to lift said closing element and continue to detach said closing element along said line of weakening, keeping the closing element always solid with the remaining part of the central zone, until said aperture is opened.

* * * * *